US007726995B2

(12) United States Patent
Suzuki et al.

(10) Patent No.: US 7,726,995 B2
(45) Date of Patent: Jun. 1, 2010

(54) CONNECTOR

(75) Inventors: Masayuki Suzuki, Koto-ku (JP); Koguchi Yasuyuki, Koto-ku (JP)

(73) Assignee: DDK Ltd., Tokyo (JP)

( * ) Notice: Subject to any disclaimer, the term of this patent is extended or adjusted under 35 U.S.C. 154(b) by 37 days.

(21) Appl. No.: 11/354,512

(22) Filed: Feb. 15, 2006

(65) Prior Publication Data

US 2006/0183364 A1 Aug. 17, 2006

(30) Foreign Application Priority Data

Feb. 15, 2005 (JP) ..... 2005-037330

(51) Int. Cl.
*H01R 13/15* (2006.01)

(52) U.S. Cl. ..... 439/260

(58) Field of Classification Search ..... 439/260, 439/79, 267, 266, 259, 329, 495
See application file for complete search history.

(56) References Cited

U.S. PATENT DOCUMENTS 6,095,865 A * 8/2000 Wu ..... 439/79
6,471,541 B2 * 10/2002 Kunishi et al. ..... 439/495
6,773,287 B2 * 8/2004 Takashita ..... 439/260
7,044,773 B2 * 5/2006 Suzuki et al. ..... 439/260

FOREIGN PATENT DOCUMENTS

| | | |
|---|---|---|
| JP | H11-307198/1999 | 11/1999 |
| JP | 2000-106238 | 4/2000 |
| JP | 2003-297489 | 10/2003 |
| JP | 2004-71160 | 3/2004 |
| JP | 2004-233197 | 8/2004 |

* cited by examiner

*Primary Examiner*—Felix O Figueroa
(74) *Attorney, Agent, or Firm*—Baker Botts L.L.P.

(57) ABSTRACT

A connector includes substantially H-shaped contacts; fixtures fixing the connector to a substrate on longitudinal ends; a housing having a ceiling portion covering contact portions of the contacts, a protection wall at the end of the ceiling portion on the fitting opening side for preventing raising of the ceiling portion on being accidentally forced upward, extension walls at the longitudinal ends for holding the fixtures, and slits each between the extension wall and a bearing for a pivoting member; and the pivoting member having an actuating portion, urging portions, and anchoring holes and mounted on the housing such that between the connection portions and the pressure receiving portions of the contacts the urging portions perform a compact pivotal movement with rotation axis moving. The connector is mounted on one side surface of the substrate to achieve more reduced overall height and superior operationality of the pivoting member.

6 Claims, 7 Drawing Sheets

CONNECTOR

CROSS-REFERENCE TO RELATED APPLICATIONS

This application claims priority from Japanese Patent Application No. 2005-37,330, filed Feb. 15, 2005, which is herein incorporated by reference in its entirety.

BACKGROUND OF THE INVENTION

The present invention relates to a connector for use in electric and electronic appliances such as mobile appliances and the like, and more particularly to a connector superior in stable electrical connection with a connecting object such as a flexible printed circuit board or flexible flat cable and capable of being mounted on a side surface of a substrate.

Connectors for use in mobile phones, CCD cameras (charge coupled device cameras) and the like are very thin in overall height and have extremely narrow pitches (so-called lighter and more compact). These connectors each mainly comprise a housing, contacts and a slider to embrace a flexible printed circuit board or flexible flat cable between the housing and the slider. Various methods may be envisioned for holding a circuit board or flat cable by the housing and the slider. There have been constructions used in many cases that after a flexible printed circuit board or flat cable has been inserted into the housing, the slider is inserted into the housing to press the circuit board or cable against the contacts.

In recent years, moreover, connectors using a pivoting member instead of the slider are increasingly being used to bring contacts into contact with a connecting object such as a flexible circuit board. In one type of these connectors, a pivoting member is pivotally moved on the side of insertion of a connecting object (front pivoting type), and in the other type, a pivoting member is pivotally moved on the opposite side of insertion of a connecting object (rear pivoting type).

The connector of the front pivoting type has been disclosed in Japanese Patent Application Opened No. 2000-106,238 (Patent Literature 1). The connectors of the rear pivoting type have been disclosed in Japanese Patent Application Opened No. 2003-297,489 (Patent Literature 2), Japanese Patent Application No. H11-307,198/1999 (Patent Literature 3), and Japanese Patent Application Opened No. 2004-71,160 (Patent Literature 4). Moreover, the applicant of the present application has proposed a connector of the rear pivoting type in Japanese Patent Application No. 2004-233,197 (Patent Literature 5).

Patent Literature 1

According to the Abstract of the Japanese Patent Application Opened No. 2000-106,238, this invention has an object to provide a connector for a cable, which requires only a slight operating force even if there are very many conductors of the cable. Disclosed in the Patent Literature 1 is a connector for a cable comprising contacts each having a contact portion facing to one surface of a cable and a pivot portion facing to the rear surface of the cable, and an actuating element adapted to press the cable against the contact portions of the contacts and having cam portions positioned between the pivot portions and the cable and holes into which the pivot portions are inserted with clearances, the pivot portions each having a recess corresponding to the cam portion so that the actuating element is adapted to engage the pivot portions in a manner that the actuating element is pivotally movable about the cam portions. By the way, claim 1 of the Japanese Patent Application Opened No. 2000-106,238 recites that in a connector including contacts each having a contact portion facing to one surface of said cable and a pivot portion facing to the opposite surface of the cable, an insulator for holding said contacts, and an actuating element for pressing the cable against the contact portions of said contacts, said actuating element includes cam portions positioned between the pivot portions and the cable and holes into which said pivot portions are inserted with clearances, respectively, and said pivot portions each having a recess corresponding to said cam portion so that said actuating element is adapted to engage the pivot portions in a manner that the actuating element is pivotally movable about the cam portions. Claim 2 recites that said insulator includes anchoring portions adapted to engage said actuating elements to hold said actuating elements in a manner that said cam portions are spaced from said contact portions of the contacts when the cable has not been connected to the connector. Claim 3 recites that said cable is a flat cable, and said insulator includes a cable anchoring groove for preventing the cable from moving in the direction progressively becoming thicker by receiving a side edge of the cable in the cable anchoring groove when the cable has been connected to the connector. Claim 4 recites that in a connector obtaining electrical connection between contacts and a cable in a manner that the surface of the cable on the opposite side of its surface facing to the contact portions of the contacts is urged against the contact portions by the rotational actuating element, said contact portions each provided with at least two contact side projections, while said actuating element is provided with actuating element side projections corresponding to spaces between said contact side projections. Claim 5 recites the connector including said contacts each having a pivot portion facing to the opposite surface of the cable and said actuating element having cam portions between the pivot portions and the cable, said cam portions each provided with said actuating element side projection.

"Patent Literature 2"

According to the Abstract of the Japanese Patent Application Opened No. 2003-297,489, this invention has an object to provide a connector of reduced overall height including an actuator to be operated by only a slight operating force and enabling contacts to move large distances to perform reliable connection of the contacts. The actuator includes cam portions and an actuating portion, and the actuator is formed between the cam portions and the actuating portion with relief grooves into and from which tips of spring portions of the contacts are inserted and removed. When the actuator is rotated clockwise about its fulcrum point through 90 degrees, the cam portions cause the spring portions and connection spring portions to be elastically deformed, thereby embracing the flexible circuit board between projections of the contact portions of the contacts to achieve electrical connection between patterns of the circuit board and a printed board through terminals of the contacts. A ceiling portion of an insulator or housing covers the contact portions of the contacts, and the lower portion under the ceiling portion on the front side is formed with a guide for inserting the circuit board into the connector. By the way, the claim 1 of the Japanese Patent Application Opened No. 2003-297,489 recites that in a connector including contacts, an insulator for holding the contacts, and an actuator rotatably mounted on the insulator and causing the contacts to be elastically deformed to bring them into contact with a connecting object, the contacts each comprise a first beam having a contact portion at its one end adapted to contact the connecting object and an actuated portion at the other end adapted to be actuated by the actuator, a second beam having a contact portion at its one end adapted to contact the connecting object and a terminal at the other end to be connected to a printed substrate, and a connecting spring for connecting the first and second beams, and said insulator has a ceiling portion for covering at least the contact portions of the contacts on the fitting side and said ceiling portion formed with a guide for guiding the insertion of the connecting object. Claim 2 recites a connector of the contacts each of which has at least one contact portion having in the proximity of the connecting spring an inclined portion inclining toward the connecting object. Claim 3 recites a connector of the actuator having an actuating portion, cam portions for actuating the actuated portions of the contacts, and relief groves positioned between the actuating portion and the cam portions so that in the state that the connecting object is not connected to the connector, the actuated portions can be inserted into the relief grooves. Claim 4 recites that in a connector including contacts, an insulator holding the contacts, and an actuator rotatably mounted on the insulator and causing the contacts to be elastically deformed to bring them into contact with a connecting object, said contacts each comprise a first beam having a contact portion at its one end adapted to contact the connecting object and an actuated portion at the other end adapted to be actuated by the actuator, a second beam having a contact portion at its one end adapted to contact the connecting object and a terminal at the other end to be connected to a printed substrate, and a connecting spring for connecting the first and second beams, said contact portion of the first beam having a first projection and a second projection extending toward the connecting object and arranged side by side in the inserting direction of the connecting object, and said contact portion of the second beam having a third projection and a fourth projection extending toward the connecting object and arranged side by side in the inserting direction of the connecting object, so that depending upon the third projection being positioned between the first and second projections or the first projection being positioned between the third and fourth projections, the first and second projections or the third and fourth projections come into contact with the connecting object.

"Patent Literature 3"

According to the Abstract of Japanese Patent Application Opened No. H11-307,198/1999, this invention has an object to improve operationality and holding power of a connector connecting a plurality of terminals and holding a flexible printed circuit board and the like. The disclosed connector for a printed circuit board includes a housing formed with inserting groove for inserting the flexible printed circuit board, a plurality of contacts provided side by side whose contact portions are arranged to extend and retract relative to the inserting groove, and an actuating member arranged pivotally movably between a connecting and a disconnecting position. The actuating member is provided with a plurality of cams so that when the actuating member is in the connecting position, contacts are urged with their actuated portions by the cams to extend their contact portions into the inserting groove thereby enabling the contact portions to be pressed against and connected to terminals of the flexible printed circuit board and holding the circuit board. On the other hand, when the actuating member is in the disconnecting position, some contacts are urged with their actuated portions by the cams to slightly extend their contact portions into the inserting groove so as to abut against the flexible printed circuit board or the like, thereby temporarily holding the circuit board, while the contact portions of the remaining contacts are retracted from the inserting groove. By the way, claim 1 of the Japanese Patent Application Opened No. H11-307,198/1999 recites that in a connector for a printed circuit board, provided with a plurality of contacts arranged side by side for connecting a plurality of terminals of a printed circuit board or the like in the lump, said connector comprises a housing having an inserting groove for inserting the printed circuit board or the like, said contacts arranged to extend and retract relative to said inserting groove, and an actuating member provided movably between a connecting and a disconnecting position, and when the actuating member is in the connecting position, the contacts are urged by the actuating member so as to extend into the inserting groove to press the terminals of the flexible printed circuit board or the like so that the contacts are connected to the terminals and hold the printed circuit board or the like, and when the actuating member is in the disconnecting position, some of the contacts extend slightly into the inserting groove to abut against and temporarily hold the printed circuit board or the like, and the remaining contacts retract relative to the inserting groove. Claim 2 recites a connector for a printed circuit board in that the plurality of the contacts are formed in the same shape and the actuating member is provided with a plurality of cams, and when the actuating member is in the connecting position, the contacts are urged by the cams to extend into the inserting groove, and when the actuating member is in the disconnecting position, the some contacts are urged by the cams to slightly extend into the inserting groove and the remaining contacts are retracted relative to the inserting groove.

"Patent Literature 4"

According to the Abstract of the Japanese Patent Application Opened No. 2004-71,160, this invention has an object to provide a connector capable of securely urging a flexible printed circuit board or flexible flat cable to contact portions of contacts with the aid of a slider without degrading strength of respective members and specifications or customers demands, and capable of being used with high operationality and fully complying with requirements such as narrower pitches of conductors and reduced overall height. This connector comprises contacts each comprising a contact portion, a connection portion, and an elastic portion and a fulcrum portion between the contact portion and the connection portion, and a pressure receiving portion extending from the elastic portion in a position facing to the connection portion, and the contact portion, elastic portion, fulcrum portion and connection portion being arranged in the form of a crank, and a slider comprising urging portions arranged continuously in the longitudinal direction and pivotally mounted on a housing so that the urging portions are pivotally moved in a space between the connection portions and pressure receiving portions of the contacts. Claim 1 of the Japanese Patent Application Opened No. 2004-71,160 recites a connector removably fitted with a flexible printed circuit board or flexible flat cable, including a required number of contacts having a contact portion adapted to contact said flexible printed circuit board or flexible flat cable, a housing holding and fixing the contacts and having a fitting opening for inserting the flexible printed circuit board or flexible flat cable, and a slider for urging the flexible printed circuit board or flexible flat cable to the contacts, wherein the contacts each comprise an elastic portion and a fulcrum portion between the contact portion and a connection portion, and a pressure receiving portion extending from the elastic portion and located in a position facing to the connection portion, and the contact portion, elastic portion, fulcrum portion and connection portion being arranged substantially in the form of a crank, and the slider is provided with urging portions continuously arranged in its longitudinal direction and is mounted on the housing so that the urging portions are pivotally moved in a space between the connection portions and pressure receiving portions of the contacts. Claim 2 recites a connector removably fitted with a flexible printed circuit board or flexible flat cable, including a required number of contacts having a contact portion adapted to contact said flexible printed circuit board or flexible flat cable, a housing holding and fixing the contacts and having a fitting opening for inserting the flexible printed circuit board or flexible flat cable, and a slider for urging the flexible printed circuit board or flexible flat cable to the contacts, wherein two kinds of contacts are arranged alternately staggered, the contacts of one kind each comprising an elastic portion and a fulcrum portion between the contact portion and a connection portion, and a pressure receiving portion extending from the elastic portion in a position facing to the connection portion, and the contact portion, elastic portion, fulcrum portion and connection portion being arranged substantially in the form of a crank, and the contacts of the other kind each comprising an elastic portion and a fulcrum portion between the contact portion and a connection portion, and a pressure receiving portion extending in the opposite direction of the contact portion, and the contact portion, elastic portion, fulcrum portion, and connection portion being arranged substantially in the form of a U-shape, and the slider is provided with urging portions arranged continuously in its longitudinal direction and mounted on the housing so that the urging portions are pivotally moved in a space between the connection portions and the pressure receiving portions of the contacts of the one kind and between the pressure receiving portions of the contacts of the other kind and the housing. Claim 3 recites that when the urging portions of the slider are pivotally moved in the space between the connection portions and the pressure receiving portions of the contacts of the one kind, the pressure receiving portions are raised by the urging portions so that the elastic portions are tilted about the fulcrum portions toward the contact portions to urge the contact portions against the flexible printed circuit board or flexible flat cable. Claim 4 recites that the pressure receiving portions of the contacts of the one kind or the other kind are each provided with a projection so that the urging portions of the slider are prevented from moving toward the connection portions of the contacts of the one kind. Claim 5 recites that the urging portions of the slider are of an elongated shape. Claim 6 recites that the slider is formed with a required number of anchoring holes independent from one another, which are adapted to engage the projections of the contacts, respectively. Claim 7 recites the elongated urging portions being in the form of an ellipsoid. Claim 8 recites a connector of contacts each provided with a further contact portion at a location extending from the fulcrum portion and adapted to contact the flexible printed circuit board or flexible flat cable. Claim 9 recites that the contacts of the other kind are each provided with an extension portion extending from the fulcrum in the opposite direction of the connection portion, and the slider is mounted on the housing so that the urging portions of the slider are pivotally moved in the space between the extension portions and the pressure receiving portions. Claim 10 recites a connector of the contacts of the other kind each provided between the fulcrum portion and the connection portion with a contact portion adapted to contact the flexible printed circuit board or flexible flat cable.

"Patent Literature 5"

According to the Abstract of the Japanese Patent Application No. 2004-233,197, this invention has an object to provide a connector which achieves a miniaturization or reduced overall height, and a stable electrical connection with simple operation and slight operating force without any failed connection even if being subjected to undue external force. Disclosed is the connector comprising contacts each including a first piece having a contact portion at one end adapted to contact the connecting object, a pressure receiving portion at the other end to be urged by the pivoting member, and a projection inwardly extending from the tip of the pressure receiving portion, a second piece having at one end a connection portion to be connected to a substrate and at the other end a fulcrum portion, and an elastic portion for connecting the first piece and the fulcrum portion, and the contact portion, elastic portion, fulcrum portion and connection portion being arranged in the form of a crank; a housing formed with protection walls at least at both the ends for preventing its ceiling portion from being raised when the connecting object is subjected to accidental external force upward; and a pivoting member including a actuating portion, urging portions, projections and anchoring holes so that the axis of rotation is moved with its pivotal movement to achieve their compact rotation. Incidentally, Claim 1 of the Japanese Patent Application No. 2004-233,197 recites a connector including a plurality of contacts having at least one contact portion adapted to contact a connecting object, a housing arranging and holding said contacts and having a fitting opening into which said connecting object is inserted, and a pivoting member for causing said contacts to be elastically deformed to urge said contacts against said connecting object, wherein said contacts each comprise a first piece having the contact portion at one end adapted to contact said connecting object, a pressure receiving portion at the other end adapted to be urged by said pivoting member, and a projection inwardly extending from the tip of said pressure receiving portion; a second piece having a fulcrum portion at one end and a connection portion at the other end adapted to be connected to a board; and an elastic portion for connecting said first piece and said fulcrum portion; and said contact portion, said elastic portion, said fulcrum portion and said connection portion being arranged substantially in the form of a crank, wherein said housing includes a ceiling portion for covering said contact portions of the contacts, said ceiling portion being formed at least on both the ends with protection walls for preventing said ceiling portion from being raised when said connecting object is accidentally subjected to undue external force upward, and wherein said pivoting member includes an actuating portion for pivotally moving said pivoting member, urging portions continuously arranged in the longitudinal direction of the pivoting member, and anchoring grooves independent from one another for receiving therein said pressure receiving portions and adapted to engage said projections, respectively, and said pivoting member is mounted on said housing so that the urging portions are pivotally moved between the connection portions and the pressure receiving portions of the contacts, and the rotational axis of said urging portions is moved with their pivotal movement to achieve their compact rotation. Claim 2 recites a connector including a plurality of contacts having at least one contact portion adapted to contact a connecting object, a housing arranging and holding said contacts and having a fitting opening into which said connecting object is inserted, and a pivoting member for causing said contacts to be elastically deformed to urge said contacts against said connecting object, wherein said contacts consist of two kinds of contacts arranged alternately staggered, said contacts of the one kind each comprising a first piece having the contact portion at one end adapted to contact said connecting object and a pressure receiving portion at the other end adapted to be urged by said pivoting member; a second piece having a fulcrum portion at one end and a connection portion at the other end adapted to be connected to a board; and an elastic portion for connecting said first piece and said fulcrum portion; and said contact portion, said elastic portion, said fulcrum portion and said connection portion being arranged substantially in the form of a crank, and said contacts of the other kind each comprising a first piece having the contact portion at one end adapted to contact said connecting object and a pressure receiving portion at the other end adapted to be urged by said pivoting member; a second piece having a connection portion at one end adapted to be connected to a board and a fulcrum portion at the other end; and an elastic portion for connecting said first piece and said fulcrum portion; and said contact portion, said elastic portion, said fulcrum portion and said connection portion being arranged substantially in the form of a U-shape, and said pressure receiving portions of the contacts of at least either the one kind or the other kind being each provided at the tip with an inwardly extending projection, wherein said housing includes a ceiling portion for covering said contact portions of the contacts, said ceiling portion being formed at least on both the ends with protection walls for preventing said ceiling portion from being raised when said connecting object is accidentally subjected to undue external force upward, and wherein said pivoting member includes an actuating portion for pivotally moving said pivoting member, urging portions continuously arranged in the longitudinal direction of the pivoting member, and anchoring grooves independent from one another for receiving therein said pressure receiving portions and adapted to engage said projections, respectively, and said pivoting member is mounted on said housing so that the urging portions are pivotally moved between the connection portions and the pressure receiving portions of the contacts of the one kind and between the pressure receiving portions of the contacts of the other kind and the housing, and the rotational axis of said urging portions is moved with their pivotal movement to achieve their compact rotation. Claim 3 recites that when the connecting object is connected to the connector, the urging portions of the pivoting member are positioned such that before connecting said connecting object to said connector, the lower ends of said urging portions are positioned between the projections of said pressure receiving portions and the connection portions and the housing or extension portions, that second on pivotally moving said actuating portion of the pivoting member, said urging portions are moved in a direction opposite to said fitting opening so that the lower ends of said urging portions are embraced between the projections of said pressure receiving portions and the connection portions and the housing or extension portions, that third on further pivotally moving said actuating portion of the pivoting member, said urging portions at their second position are pivotally moved about the center of said urging portions as their rotational axis, that fourth on further pivotally moving said actuating portion of the pivoting member, said urging portions at their third position are pivotally moved about the center of said urging portions as their rotational axis so that said urging portions stand substantially upright between said pressure receiving portions and said connection portions and the housing or the extension portions, and the rotational axis is moved toward the upper ends of said urging portions in contact with said projections, and that finally on further pivotally moving said actuating portion of the pivoting member, said urging portions at their fourth position are pivotally moved about a center in the proximity of the upper ends of said urging portions in contact with said projections to cause said urging portions to engage said projections. Claim 4 recites that said ceiling portion is further provided with a protection wall substantially at its center for preventing said ceiling portion from being raised when the connecting object is accidentally subjected to undue external force upward. Claim 5 recites that said contacts and said contacts of the one kind are each provided with an extension portion extending from the fulcrum portion in such a direction that said extension portion faces to said contact portion. Claim 6 recites that said contacts of the other kind are each provided with an extension portion extending from the fulcrum portion in such a direction that said extension portion faces to said pressure receiving portion, and said pivoting member is mounted on the housing so that said urging portions of the pivoting member are pivotally moved between said extension portions and said pressure receiving portions. Claim 7 recites that a further contact portion adapted to contact the connecting object is provided on said extension portion of each of said contacts and said contacts of the one kind, and a further contact portion adapted to contact the connecting object is also provided between said fulcrum portion and the connection portion of each of said contacts of the other kind. Claim 8 recites that said housing is provided with recessed portions on the side of the fitting opening for conducting a connecting object, and the contacts of the other kind are so arranged that the connection portions of the contacts do not extend from said recessed portions. Claim 9 recites that the connecting object is provided with anchoring portions, and there are provided locking members each having an engaging portion adapted to engage said anchoring portion and said locking means are substantially the same in construction as that of said contacts, said contacts of the one kind or said contacts of the other kind. Claim 10 recites that said further contact portion provided on said extension portion of each of said contacts and said contacts of the one kind is constructed to have elasticity, and said further contact portion provided between the fulcrum portion and the connection portion of each of said contacts of the other kind is constructed to have elasticity. Claim 11 recites that the housing is provided with anchoring portions at locations corresponding to the connection portions of said contacts or said contacts of the one kind, while the connection portions of said contacts and said contacts of the one kind are each provided with an inclined engaging portion adapted to engage said anchoring portion, and said extension portions of said contacts and said contacts of the one kind are not held by the housing. Claim 12 recites that when inserting said contact or said contact of the one kind into said housing from the opposite side of said fitting opening, at the commencement of the engagement of the anchoring portion with the engaging portion, the contact portion of the contact is substantially in parallel with an inserting hole of the housing, and on proceeding of the insertion the contact is obliquely inclined so that the contact portion of the contact comes into contact with the upper wall of the inserting hole, and wherein when the insertion of the contact has been completed, the contact portion has returned in parallel with the inserting hole with the aid of said inclined engaging portion.

In the above connectors disclosed in the Patent Literatures 1 to 5, the pivoting member is pivotally moved on the side of the fitting opening or on the opposite side thereto to bring the contacts into contact with a connecting object such as a flexible printed circuit board, and the connector is mounted onto the upper or lower surface of a substrate in either case.

Even with these connectors disclosed in the Patent Literatures 1 to 5, the connector is frequently mounted onto a substrate on its side surface depending on a customer's specification or owing to a limitation of mounting space of a substrate. With the connectors of these Literatures, however, in the case that parts are mounted only one surface of a substrate according to a customer's specification, it would be impossible to achieve a reduced overall height (height of mounted connector) of not more than 0.9 mm and, in addition, operation of the pivoting member would become difficult.

Moreover, the connectors disclosed in the Patent Literatures 1 to 5 suffer a disadvantage from poor holding forces for connectors so that they would be dislodged from the substrate when a connecting object such as a flexible printed circuit board is subjected to an accidental external force.

SUMMARY OF THE INVENTION

It is an object of the invention to provide a connector which eliminates all the disadvantages of the prior art described above and which achieves a further reduced overall height of the connector and a higher operationality of the pivoting member without any risk of dislodgement of the connector even if it is mounted onto the side surface of a substrate.

The above object can be achieved by the connector 10 according to the invention to be mounted to a side surface of a substrate 80, including a plurality of contacts 14 each having at least one contact portion 38 adapted to contact a connecting object, a housing 12 for arranging and holding the contacts 14 and having a fitting opening 30 into which the connecting object is inserted, and a pivoting member 16 causing the contacts 14 to be elastically deformed and pressed against the connecting object, wherein the connector comprises the contacts 14 each including a first peace 34 having the contact portion 38 at one end adapted to contact the connecting object, a pressure receiving portion 40 at the other end adapted to be pressed by the pivoting member 16, and a projection 42 inwardly extending from the tip of the pressure receiving portion 40, a second piece 36 having a further contact portion 38 at one end, a connection portion 48 at the other end to be connected to the substrate 80, and a fulcrum portion 44 between the further contact portion 38 and the connection portion 48, and an elastic portion 46 for connecting the first piece 34 and the fulcrum portion 44, the contact portion 38, the elastic portion 46, the fulcrum portion 44 and the connection portion 48 being arranged in the form of a crank; fixtures 18 at longitudinal ends of the connector for fixing the connector to the substrate 80; the housing 12 including a ceiling portion 20 for covering the contact portions 38 of the contacts 14, the ceiling portion 20 being formed with a protection wall 22 at the end of the ceiling portion 20 on the side of the fitting opening 30 for preventing the ceiling portion 20 from being raised when the connecting object is accidentally subjected to an undue external force upward, and the housing further including extension walls 24 at its longitudinal ends for holding the fixtures 18, and slits 26 each between the extension wall 24 and a bearing 28 for the pivoting member 16; and the pivoting member 16 including an actuating portion 60 for pivotally moving the pivoting member, urging portions 56 continuously arranged in the longitudinal direction of the pivoting member, and anchoring holes 58 independent from one another for receiving therein the pressure receiving portions 40 and adapted to engage the projections 42, respectively, the pivoting member 16 being mounted on the housing 12 so that urging portions 56 are pivotally moved between the connection portions 48 and the pressure receiving portions 40 of the contacts 14, and the rotation axis 64 of the urging portions 56 is moved with their pivotal movement to achieve their compact rotation, and wherein the substrate 80 is provided with a notch 82, and the connector 10 is connected onto the substrate in a manner that the connector is accommodated in the notch 82 of the substrate.

The connector 10 is connected onto the substrate 80 such that the substrate is positioned on the side of the upper surfaces 52 of the connection portions 48 of the contacts 14, and the pivoting member 16 is operated on the opposite side of the connection portions of the contacts with respect to the substrate.

When the connecting object is connected to the connector 10, the urging portions 56 of the pivoting member 16 are positioned such that before connecting the connecting object to the connector 10, the lower ends 68 of the urging portions 56 are positioned between the projections 42 of the pressure receiving portions 40 and the connection portions 48 of the contacts, that second on pivotally moving the actuating portion 60 of the pivoting member, the urging portions 56 are moved in a direction opposite to the fitting opening 30 so that the lower ends 68 of the urging portions are embraced between the projections 42 of the pressure receiving portions 40 and the connection portions 48 of the contacts, that third on further pivotally moving the actuating portion 60 of the pivoting member, the urging portions 56 at their second position are pivotally moved about the center of the urging portions 56 as their rotation axis 64, that fourth on further pivotally moving the actuating portion 60 of the pivoting member, the urging portions 56 at their third position are pivotally moved about the center of the urging portions 56 as their rotation axis 64 so that the urging portions 56 stand substantially upright between the pressure receiving portions 40 and the connection portions 48, and the rotation axis 64 is moved toward the upper ends 66 of the urging portions in contact with the projections 42, and that finally on further pivotally moving the actuating portion 60 of the pivoting member, the urging portions 56 at their fourth position are pivotally moved about a center in the proximity of the upper ends 66 of the urging portions in contact with the projections 42 to cause the urging portions 56 to engage the projections 42.

The functions of the connector according to the invention are as follows. After a connecting object such as a flexible printed circuit board or flexible flat cable has been inserted into the fitting opening 30 of the housing 12, when the urging portions 56 of the pivoting member 16 are pivotally moved between the connection portions 48 and the pressure receiving portions 40 of the contacts 14, the pressure receiving portions 40 are raised by the urging portions 56 so that the elastic portions 46 of the contacts 14 are tilted about the fulcrum portions 44 of the contacts 14 toward the contact portions 38 positioned upward, whereby the contact portions 38 are forced against the connecting object such as the flexible printed circuit board or flexible flat cable and the like.

As can be seen from the above descriptions, the connector 10 according to the invention can bring about the following significant effects.

(1) According to the invention the connector 10 to be mounted to a side surface of a substrate 80, including a plurality of contacts 14 each having at least one contact portion 38 adapted to contact a connecting object, a housing 12 for arranging and holding the contacts 14 and having a fitting opening 30 into which the connecting object is inserted, and a pivoting member 16 causing the contacts 14 to be elastically deformed and pressed against the connecting object, comprises the contacts 14 each including a first peace 34 having the contact portion 38 at one end adapted to contact the connecting object, a pressure receiving portion 40 at the other end adapted to be pressed by the pivoting member 16, and a projection 42 inwardly extending from the tip of the pressure receiving portion 40, a second piece 36 having a further contact portion 38 at one end, a connection portion 48 at the other end to be connected to the substrate 80, and a fulcrum portion 44 between the further contact portion 38 and the connection portion 48, and an elastic portion 46 for connecting the first piece 34 and the fulcrum portion 44, the contact portion 38, the elastic portion 46, the fulcrum portion 44 and the connection portion 48 being arranged in the form of a crank; fixtures 18 at longitudinal ends of the connector for fixing the connector to the substrate 80; the housing 12 including a ceiling portion 20 for covering the contact portions 38 of the contacts 14, the ceiling portion 20 being formed with a protection wall 22 at the end of the ceiling portion 20 on the side of the fitting opening 30 for preventing the ceiling portion 20 from being raised when the connecting object is accidentally subjected to an undue external force upward, and the housing further including extension walls 24 at its longitudinal ends for holding the fixtures 18, and slits 26 each between the extension wall 24 and a bearing 28 for the pivoting member 16; and the pivoting member 16 including an actuating portion 60 for pivotally moving the pivoting member, urging portions 56 continuously arranged in the longitudinal direction of the pivoting member, and anchoring holes 58 independent from one another for receiving therein the pressure receiving portions 40 and adapted to engage the projections 42, respectively, the pivoting member 16 being mounted on the housing 12 so that urging portions 56 are pivotally moved between the connection portions 48 and the pressure receiving portions 40 of the contacts 14, and the rotation axis 64 of the urging portions 56 is moved with their pivotal movement to achieve their compact rotation, and further the substrate 80 is provided with a notch 82, and the connector 10 is connected onto the substrate in a manner that the connector is accommodated in the notch 82 of the substrate. Therefore, even with the connector 10 mounted on the side surface of the substrate 80 and in the event that the connecting object such as the flexible printed circuit board 70 is subjected to an accidental external force, the connector 10 is never dislodged from the substrate, and it is possible to achieve a reduced overall height of connector by the thickness of the substrate 80. For example, even if the overall height of an unimproved connector is 1.0 mm and a substrate is 0.4 mm in thickness, the overall height including the substrate becomes substantially 0.6 mm.

(2) According to the invention, the connector 10 is connected onto the substrate 80 such that the substrate is positioned on the side of the upper surfaces 52 of the connection portions 48 of the contacts 14, and the pivoting member 16 is operated on the opposite side of the connection portions of the contacts with respect to the substrate. Consequently, it becomes possible to reduce the overall height of the connector by the thickness of the substrate 80, and the pivoting member 16 is easily operated because it can be operated on the side of the substrate where the connector 10 and other parts are not mounted.

(3) According to the invention, when the connecting object is connected to the connector 10, the urging portions 56 of the pivoting member 16 are positioned such that before connecting the connecting object to the connector 10, the lower ends 68 of the urging portions 56 are positioned between the projections 42 of the pressure receiving portions 40 and the connection portions 48 of the contacts, that second on pivotally moving the actuating portion 60 of the pivoting member, the urging portions 56 are moved in a direction opposite to the fitting opening 30 so that the lower ends 68 of the urging portions are embraced between the projections 42 of the pressure receiving portions 40 and the connection portions 48 of the contacts, that third on further pivotally moving the actuating portion 60 of the pivoting member, the urging portions 56 at their second position are pivotally moved about the center of the urging portions 56 as their rotation axis 64, that fourth on further pivotally moving the actuating portion 60 of the pivoting member, the urging portions 56 at their third position are pivotally moved about the center of the urging portions 56 as their rotation axis 64 so that the urging portions 56 stand substantially upright between the pressure receiving portions 40 and the connection portions 48, and the rotation axis 64 is moved toward the upper ends 66 of the urging portions in contact with the projections 42, and that finally on further pivotally moving the actuating portion 60 of the pivoting member, the urging portions 56 at their fourth position are pivotally moved about a center in the proximity of the upper ends 66 of the urging portions in contact with the projections 42 to cause the urging portions 56 to engage the projections 42. Accordingly, the urging portions 56 of the pivoting member 16 do not rotated about a fixed axis, but the fulcrum of the urging portions 56 is moved with the pivotal movement of the pivoting member 16 so that a compact and space-saving pivotal movement can be achieved, thereby preventing fatigue of spring and high locking forces. The urging portions 56 are fixed by three points of the pressure receiving portions 40, the connection portions 48 and the projections 42 to produce the torque for reliably bringing the contacts into contact with the connecting object.

The invention will be more fully understood by referring to the following detailed specification and claims taken in connection with the appended drawings.

DESCRIPTION OF THE PREFERRED EMBODIMENTS

Figure 1A:
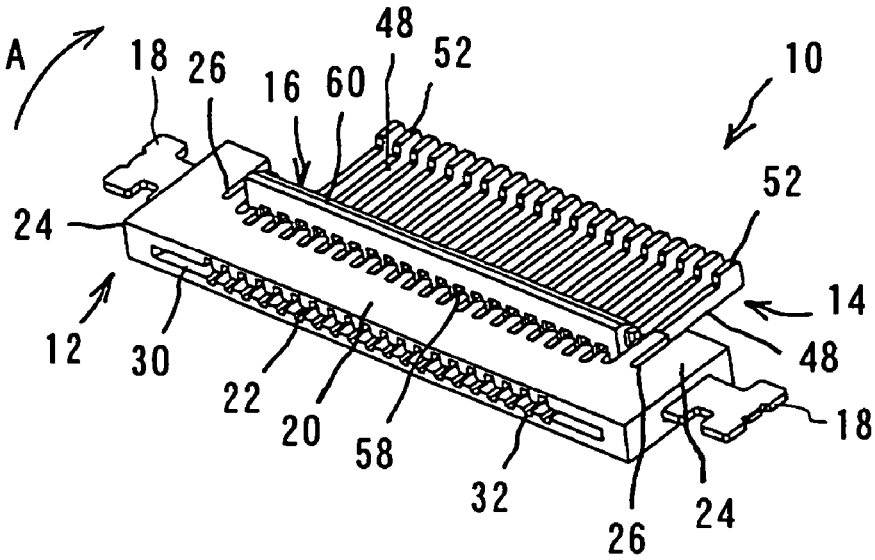
FIG. 1A is a perspective view of the connector according to the invention with the pivoting member opened, viewed from the fitting opening side.
Figure 1B:
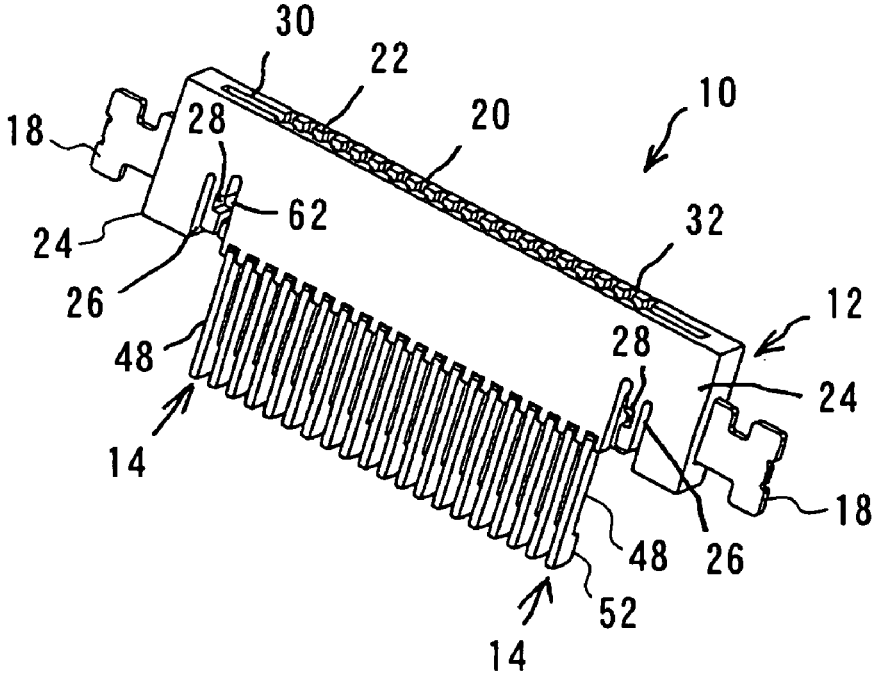
FIG. 1B is a perspective view of the connector according to the invention with the pivoting member opened, viewed from the connection portion side.
Figure 2A:
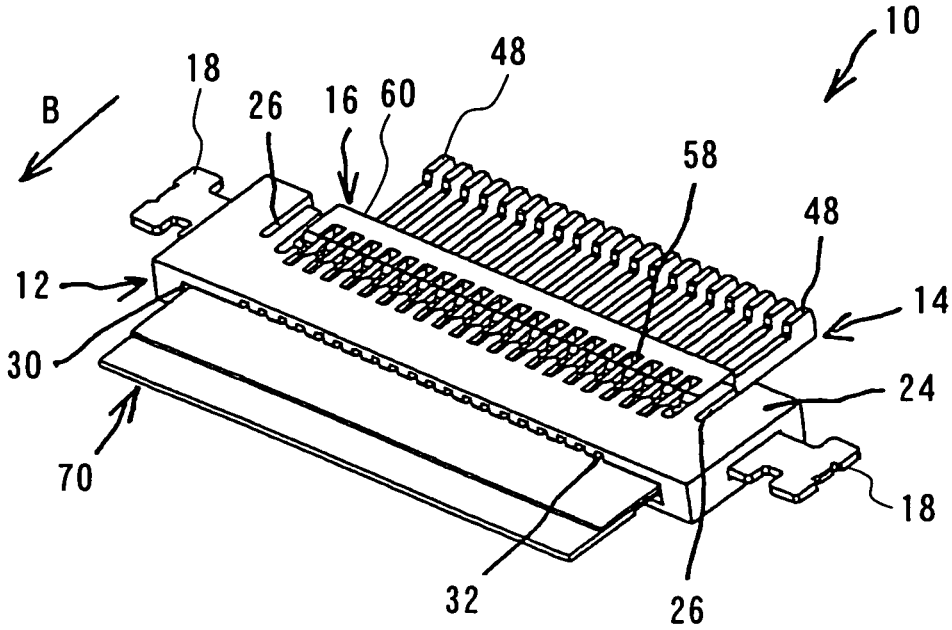
FIG. 2A is a perspective view of the connector with a flexible printed circuit board inserted, viewed from the fitting opening side.
Figure 2B:
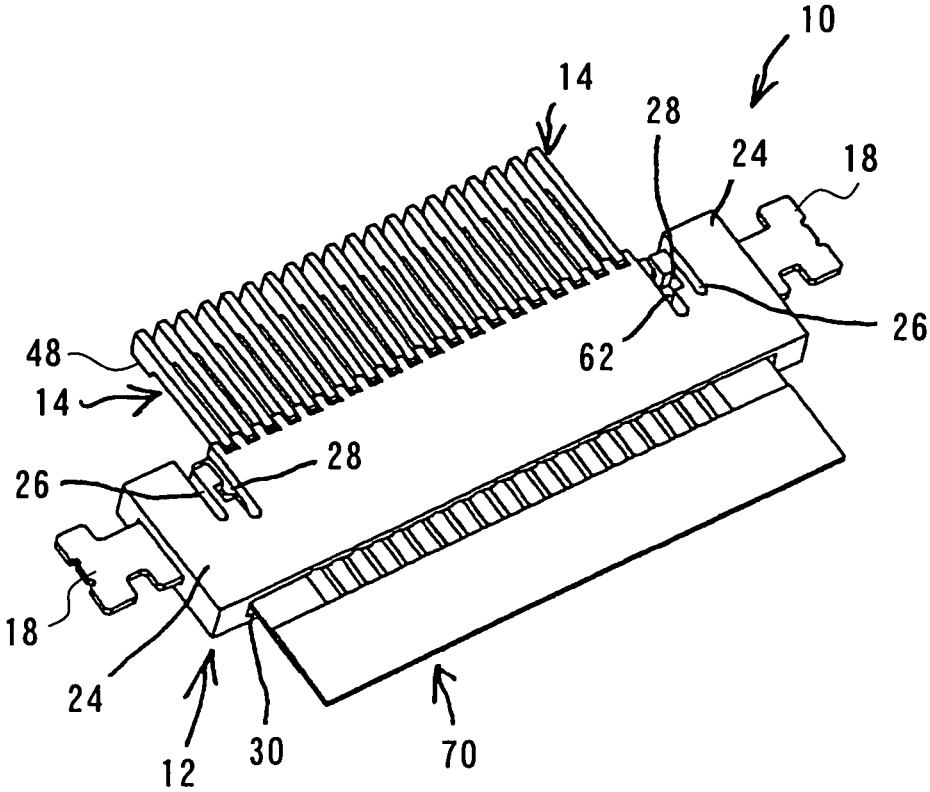
FIG. 2B is a perspective view of the connector with a flexible printed circuit board inserted, viewed from the connection portion side.
Figure 3A:
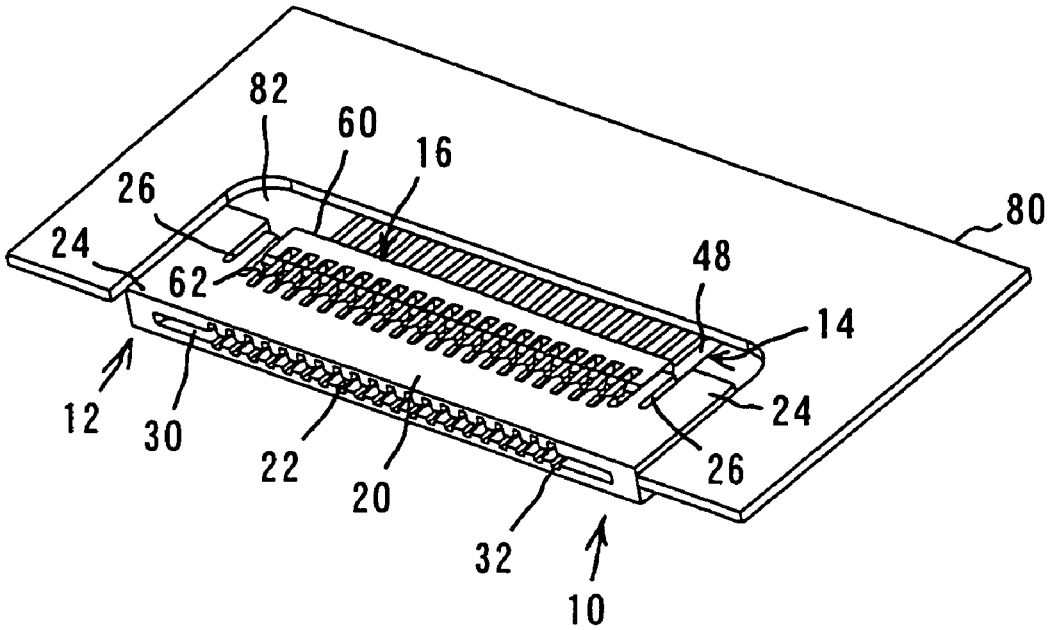
FIG. 3A is a perspective view of the connector which is mounted on a substrate, viewed from the fitting opening side.
Figure 3B:
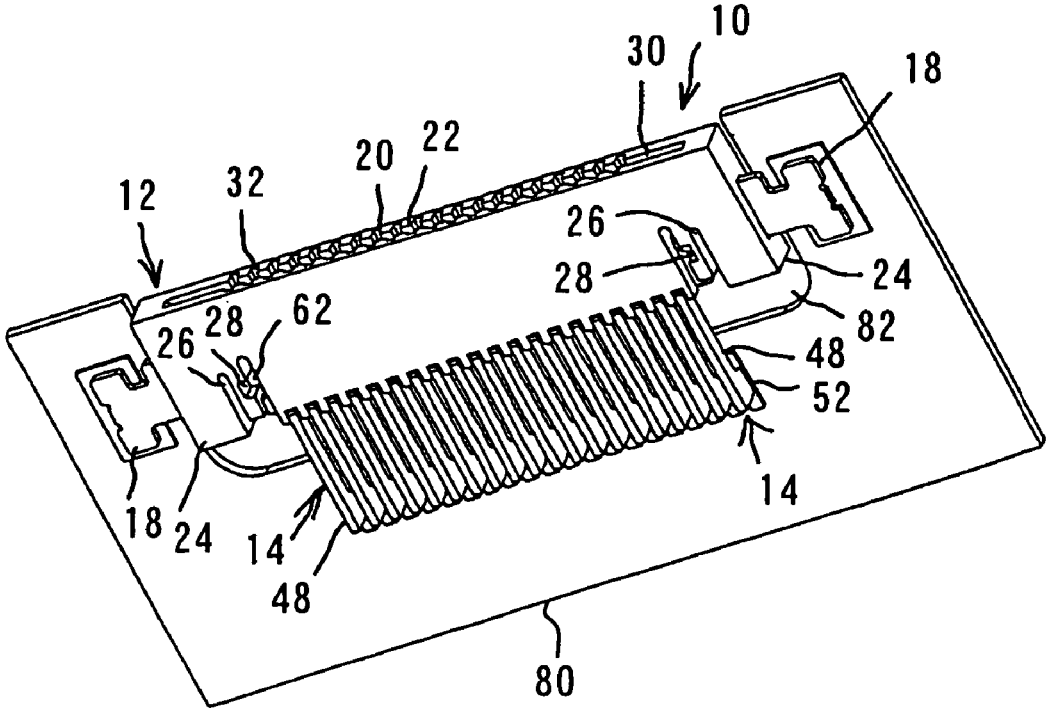
FIG. 3B is a perspective view of the connector which is mounted on a substrate, viewed from the connection portion side.
Figure 4A:
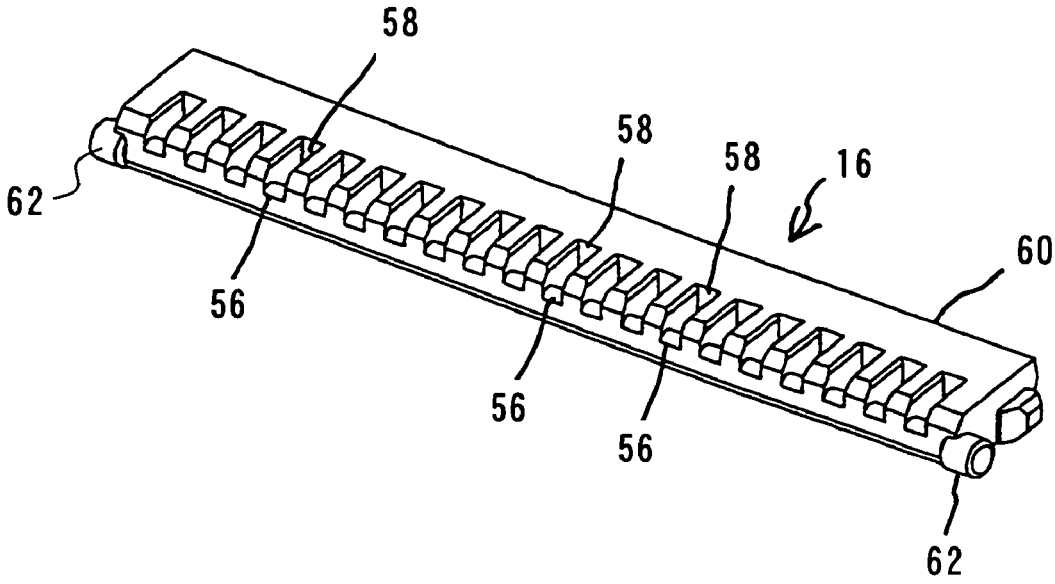
FIG. 4A is a perspective view of the pivoting member viewed from the fitting opening side.
Figure 4B:
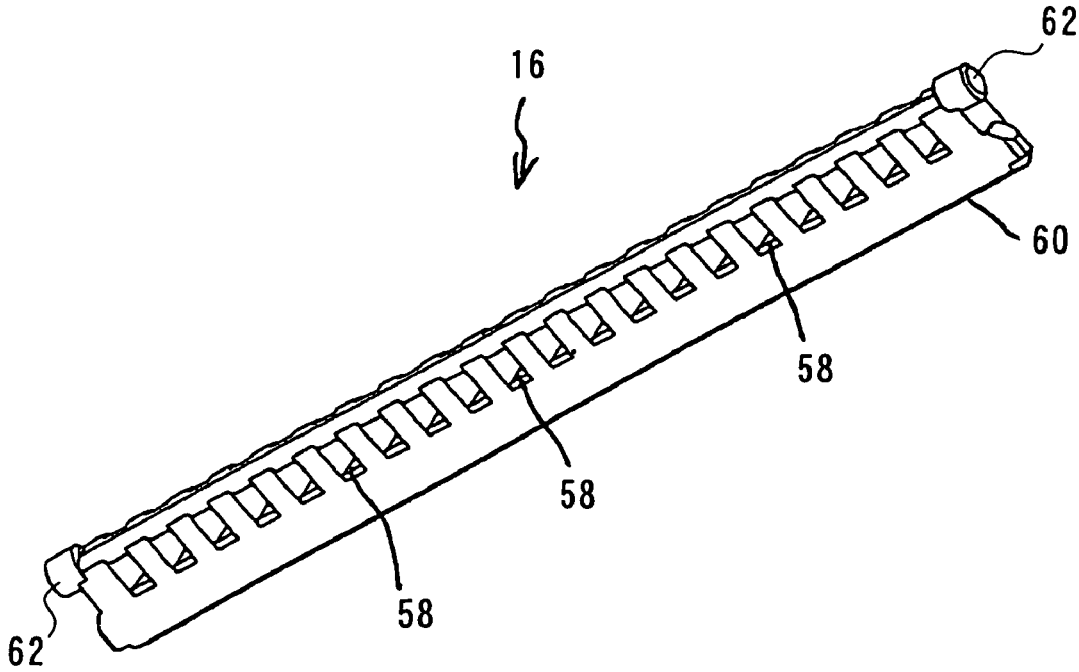
FIG. 4B is a perspective view of the pivoting member viewed from the connection portion side.
Figure 5:
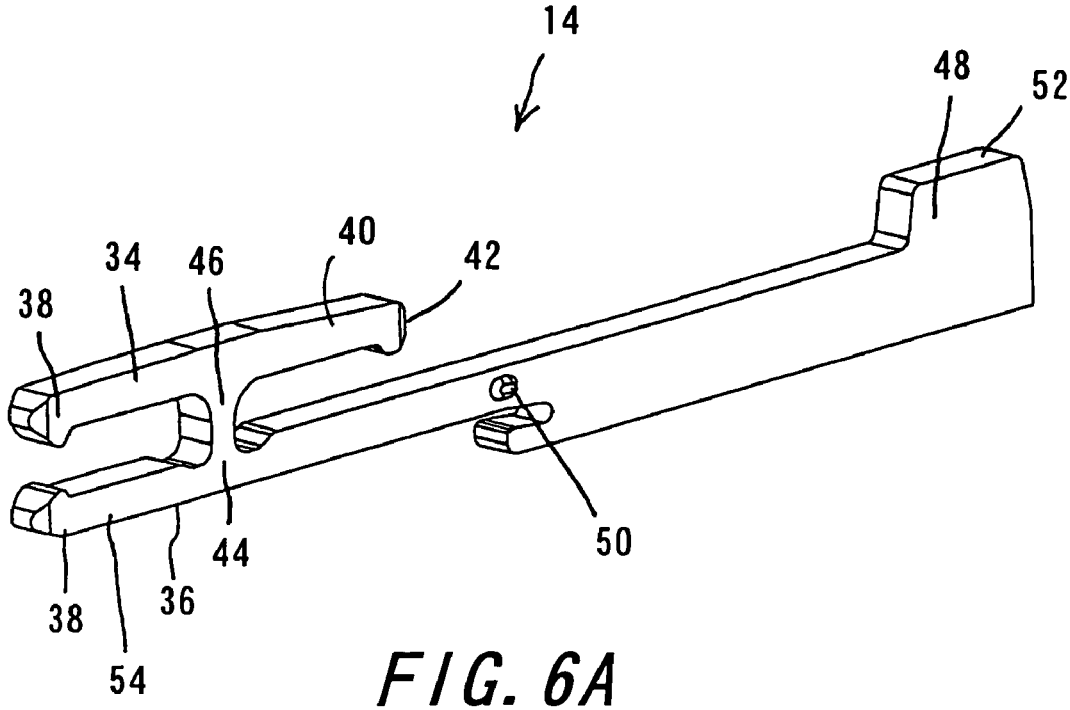
FIG. 5 is a perspective view of a contact having two contact portions.
Figure 6A:
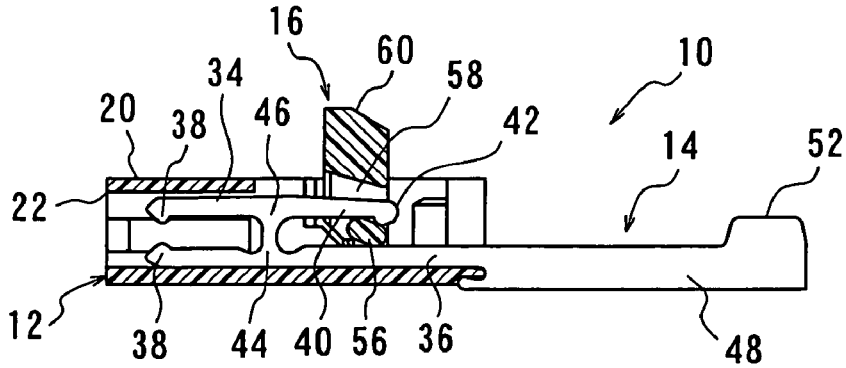
FIG. 6A is a sectional view of the connector not having a flexible printed circuit board taken along one contact.
Figure 6B:
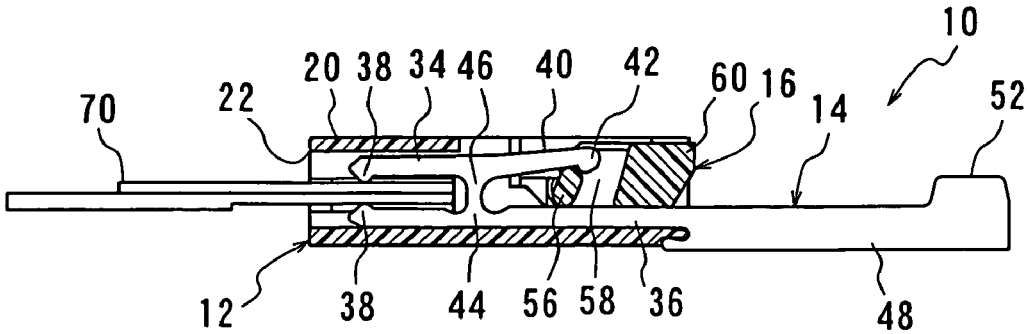
FIG. 6B is a sectional view of the connector with a flexible printed circuit board inserted taken along one contact.

One embodiment of the connector according to the invention will be explained with reference to FIGS. 1A to 8. FIG. 1A is a perspective view of the connector according to the invention with a pivoting member opened, viewed from the fitting opening side, and FIG. 1B is the connector shown in FIG. 1A viewed from the connection portion side. FIG. 2A is a perspective view of the connector with a flexible printed circuit board inserted, viewed from the fitting opening side, and FIG. 2B is a perspective view of the connector shown in FIG. 2A viewed from the connection portion side. FIG. 3A is a perspective view of the connector mounted on a substrate, viewed from the fitting opening side, and FIG. 3B is a perspective view of the connector mounted on the substrate, viewed from the connection portion side. FIG. 4A is a perspective view of the pivoting member viewed from the fitting side, and FIG. 4B is a perspective view of the pivoting member viewed from the connection side. FIG. 5 is a perspective view of a contact having two contact portions. FIG. 6A is a sectional view of the connector not having a flexible printed circuit board inserted, taken along one contact, and FIG. 6B is a sectional view of the connector with the flexible printed circuit board inserted, taken along one contact. FIGS. 7A to 7E are views for explaining movements of the urging portion and rotation axis when the pivoting member is pivotally moved. FIG. 8 is a graph illustrating results of a test for holding forces of the connector according to the invention.

The connector 10 according to the invention mainly comprises a housing 12, a pivoting member 16, contacts 14 and fixtures 18.

The components of the connector according to the invention will be explained with reference to the drawings. First, the contacts 14 will be explained. The contacts 14 are made of a metal and formed by means of the press-working of the known technique. Preferred metals from which to form the contacts 14 include brass, beryllium copper, phosphor bronze and the like which comply with the requirements such as springiness, electric conductivity and the like.

As shown in FIG. 5, the contact 14 is substantially in the form of "H", and comprises a first peace 34 having a contact portion 38 at one end adapted to contact a connecting object, a pressure receiving portion 40 at the other end adapted to be urged by the pivoting member 16, and a projection 42 inwardly extending from the tip of the pressure receiving portion 40; a second piece 36 having a further contact portion 38 at one end, a connection portion 48 at the other end to be connected to a substrate 80, and a fulcrum portion 44 between the further contact portion 38 and the connection portion 48; and an elastic portion 46 for connecting the first piece 34 and the fulcrum portion 44 of the second piece 36; and a fixed portion 50 in the proximity of the connection portion 48. The contact portion 38 of the first piece 34, the elastic portion 46, the fulcrum portion 44 and the connection portion 38 are arranged substantially in the form of a crank.

The contact portions 38 of the first and second pieces are each formed as a projection to facilitate the contacting with the connecting object such as a flexible printed circuit board, flexible flat cable or the like. Although the connection portions 48 are shown of a surface mounting type (SMT) in the embodiment of FIG. 5, it will be apparent that they may be of a dip type. In the embodiment, there are provided the two contact portions 38 to embrace the flexible printed circuit board 70 or flat cable therebetween. By providing the two contact portions 38 on both sides of the inserting direction of the circuit board 70 or flat cable, it is embraced by the two contacts 38 of each of the contacts 14 to ensure the reliable connection therebetween.

When a connecting object such as the flexible printed circuit board 70 or flexible flat cable is inserted into the connector, the fulcrum portion 44, the elastic portion 46 and the pressure receiving portion 40 will perform the following functions. After the connecting object such as the circuit board 70, the flat cable, or the like has been inserted into the fitting opening 30 of the housing 12, the urging portions 56 of the pivoting member 16 are pivotally moved between the connection portions 48 and the pressure receiving portions 40 of the contacts 14 to raise the pressure receiving portions 40 by the urging portions 56 so that the elastic portions 46 of the contacts 14 are tilted about the fulcrum portions 44 of the contacts 14 toward the contact portions 38 of the first pieces 34 to urge the contact portions 38 against the connecting object such as the flexible printed circuit board 70, the flat cable or the like. Sizes and shapes of the fulcrum portions 44, the elastic portions 46 and the pressure receiving portions 40 may be suitably designed to achieve these functions.

The pressure receiving portions 40 of the contacts 14 include at their tips the respective projections 42 as described above which are caused to engage the urging portions 56 of the pivoting member 16 when the urging portions 56 of the pivoting member 16 are pivotally moved between the pressure receiving portions 40 and the connection portions 48 of the contacts 14, thereby preventing the center of the pivoting member 16 from being deformed in the direction shown by an arrow B in FIG. 2A due to strong reaction forces against the pivotal movement of the pivoting member 16. The size of the projections 42 may be any one so long as they can achieve their functions and may be suitably designed to cause the projections 42 to engage the urging portions 56 of the pivoting member 16.

Moreover, the projections 42 also serve to hold the urging portions 56 of the pivoting member 16 to prevent the urging portions 56 from falling down when the pivotal movement of the pivoting member 16 is completed and the connecting object contacts the contacts 14.

The pivoting member 16 will then be explained. The pivoting member 16 is formed from an electrically insulating plastic material by means of the injection molding of the known technique. The materials suitable for the pivoting member 16 include polybutylene terephthalate (PBT), polyamide (66PA or 46PA), liquid crystal polymer (LCP), polycarbonate (PC) and the like and combination thereof in consideration of dimensional stability, workability, manufacturing cost and the like. The pivoting member 16 mainly comprises an actuating portion 60, axles 62 adapted to be fitted in the housing 12 for pivotal movement of the pivoting member 16 relative to the housing 12, the urging portions 56 for urging the pressure receiving portions 40 of the contacts 14, and the anchoring holes 48 to be engaged by the projections 42 of the contacts 14. The axles 62 are a fulcrum for pivotally moving the pivoting member 16 and rotatably supported in the housing 12 at its longitudinal ends. The pivoting member 16 is further provided at its longitudinal ends with locking portions adapted to engage the housing 12 for preventing the pivoting member 16 from being raised upwardly (viewed in the drawing) when raising the pressure receiving portions 40 of the contacts 14. The shape and size of the locking portions may be arbitrary insofar as they can engage the housing 12 and may be suitably designed in consideration of the above function and the size, strength and the like of the connector.

The urging portions 56 are for pushing the pressure receiving portions 40 of the contacts 14. The urging portions are preferably of an elongated shape, and elliptical in the illustrated embodiment. With such an elliptical shape, when the pivoting member 16 is pivotally moved in the direction shown by an arrow A as shown in FIG. 1A so as to pivotally move its urging portions between the pressure receiving portions 40 and the connection portions 48 of the contacts 14, the pressure receiving portions 40 of the contacts 14 are moved upward with the aid of the variation in contact height of the urging portions 56 owing to, for example, difference in major and minor axes of an ellipse so that the contact portions 38 of the contacts 14 are forced against the connecting object such as the circuit board 70, flat cable or the like. The shape of the urging portions 56 may be arbitrary so long as they can be rotated between the pressure receiving portions 40 and the connection portions 38 of the contacts 14, and the pressure receiving portions 40 of the contacts 14 can be raised with the aid of the variation in contact height such as a difference in major and minor axes of the ellipse.

The pivoting member 16 is further provided with the anchoring holes 58 independently from one another which are adapted to be engaged by the projections 42 of the contacts 14, in order to prevent the center of the pivoting member 16 from being deformed in the direction shown by the arrow B in FIG. 2A owing to the strong reaction forces against the pivotal movement of the pivoting member 16 when it is pivotally moving. The anchoring holes 58 provided independently from one another contribute to enhancing the strength of the pivoting member 16 and prevent the deformation of the pivoting member when it is pivotally moving.

The housing 12 will then be explained. The housing 12 is injection molded from an electrically insulating plastic material in the conventional manner. Preferred materials from which to form the housing include polybutylene terephthalate (PBT), polyamide (66PA or 46PA), liquid crystal polymer (LCP), polycarbonate (PC) and the like and combinations thereof in view of the requirements imposed on the housing 12 such as dimensional stability, workability, manufacturing cost and the like.

The housing 12 is formed with inserting grooves or holes 38 in which a required number of contacts 14 are inserted and fixed thereat by press-fitting, lancing, welding or the like. The housing 12 is further provided in the proximity of the longitudinal ends with holes or bearings 28 for rotatably supporting the axles 62 of the pivoting member 16. The holes or bearings 28 of the housing 12 can be in any shape and size so long as the axles 62 of the pivoting member 16 can be rotated, and may be suitably designed in consideration of their functions and the strength and size of the housing 12. The housing 12 is further provided at the longitudinal ends with anchoring portions at locations corresponding to the locking portions of the pivoting member 16.

The housing 12 is provided at longitudinal ends with extension walls 24 for fixing the fixtures 18. The size of the extension walls 24 may be designed in consideration of the miniaturization of the connector 10 and forces for holding the fixtures 18. The housing 12 is formed with slits 26 each between the extension wall 24 and the bearing 28. The slits 26 provide an elasticity for facilitating the engagement of the locking portions of the pivoting member 16 with the housing 12. The size of the slits 26 may be suitably designed in consideration of their function, the miniaturization of the connector, the strength of the housing 12 and the like.

The housing 12 has a ceiling portion 20 covering or insulating the contact portions 38 of the first pieces 34 of the contacts 14, and the ceiling portion 20 is formed with a protection wall 22 at the end on the side of the fitting opening 30 for preventing the ceiling portion 20 from deforming upwardly when the connecting object is forced upward inadvertently. The term "protection wall" 22 means an edge shaped wall end without being chamfered or inclined at the front end of the fitting opening 30. In the illustrated embodiment, the protection wall 22 is provided on all the end on the side of the fitting opening of the connector. By providing the protection wall 22, however, function and effect for guiding the connecting object such as the flexible printed circuit board 70 and the like may become impossible. As a method for guiding the connecting object such as the flexible printed circuit board 70 into the fitting opening 30, the connecting object is conducted into the fitting opening 30 shown in FIGS. 1A and 3A in a manner putting or applying it onto the lower face of the fitting opening 30 of the housing 12, thereby easily guiding it into the fitting opening 30.

In order to ascertain the effects of the protection wall, under a condition of the connector with a flexible printed circuit board 70 inserted, the flexible printed circuit board 70 was pulled in a direction perpendicular to the connector in a tension tester (this condition is the same as that the printed circuit board is accidentally forced upwardly when the connector is used in its horizontal position). The results are shown in Table 1 below and a graph of FIG. 8. The "holding force" in the Table 1 and FIG. 8 means the force at a moment when the contacts 14 are disconnected from the flexible printed circuit board 70, while the flexible printed circuit board 40 is being pulled.

In the Table 1 and FIG. 8, the prior art connector is the connector having the fitting opening 30 of which ceiling portion 20 is chamfered all over it without any protection wall 22. The improved connector 1 is the connector having the fitting opening of which ceiling portion is provided with protection walls 22 only at both the ends (both the ends are not chamfered). The improved connector 2 is the connector having the fitting opening of which ceiling portion 20 is provided with a protection wall 22 all over it.

TABLE 1

| | | Number of conductors | | | | | | | |
|---|---|---|---|---|---|---|---|---|---|
| | | 18 | | | | 27 | | | |
| | | Sample No. | | | | | | | |
| | | 1 | 2 | 3 | 4 | 1 | 2 | 3 | 4 |
| Prior art | | 3.6 N | 3.6 N | 4.1 N | 4.0 N | 4.2 N | 4.8 N | 4.6 N | 4.5 N |
| Improved connector | All over ceiling | 9.1 N | 9.1 N | 8.8 N | 8.9 N | 9.1 N | 9.0 N | 9.0 N | 8.9 N |
| | Only at both ends | 8.6 N | 8.2 N | 8.4 N | 8.5 N | 9.2 N | 8.8 N | 8.6 N | 9.1 N |
| Mean value of prior art | | 3.83 N | | | | 4.53 N | | | |
| Mean value of improved ones | All over ceiling | 8.98 N | | | | 9.00 N | | | |
| | Only at both ends | 8.43 N | | | | 8.93 N | | | |

Referring to the Table 1 and FIG. 8 graphically illustrating the results of the test, with respect to the mean values, the holding forces (forces at disconnection of the contacts) of the improved connectors 1 (protection walls only at ends) and the improved connectors 2 (protection wall all over the ceiling portion) with 18 conductors increase by 4.6N and 5.2N, respectively. On the other hand, the holding forces of the improved connectors 1 and 2 with 27 conductors increase by 4.4N and 4.5N, respectively. Accordingly, with the improved connectors 1 and 2, the holding forces are approximately twice those of the prior art connectors. It is clearly evident that the holding forces (forces at disconnection of contacts) are remarkably increased by providing the protection wall 22 at only both the ends or all over the fitting opening 30. In other words, by providing the protection wall 22 only on both the sides of the fitting opening 30 or all over it, the holding forces signifying the stability of contact between the contacts and the connecting object will increase twice when being applied with accidental external forces. This means increased stability for the accidental external forces. It is also apparent that there is no large difference in holding forces between the protection walls 22 provided only at both the ends and the protection wall all over the ceiling portion of the fitting opening. The improved percentages of holding forces are 220.3% with 18 conductors and 197.2% with 27 conductors. The improved percentage is the value obtained by dividing a holding force for an improved connector by a holding force for a prior art connector.

The number and location to be provided with the protection wall 22 are preferably as few as possible in consideration of the fact that there is no large difference in holding forces between the protection walls 22 provided only at both the ends and provided all over the ceiling portion of the fitting opening, and the prevention of the object such as the flexible printed circuit board 70 from being scratched (damaged). In the illustrated embodiment, the protection wall is provided all the portions of the fitting opening 30 in consideration of the stabilization for accidental external forces. However, it is of course preferable to provide the protection walls at three locations, that is, at both the ends and, in addition, at the center in view of balancing. In order to prevent the connecting object such as the flexible printed circuit board 70 from being scratched (damaged), it is preferable to design the housing in a manner that it does not contact the connecting object when the connecting object is accidentally subjected to an external force. For this purpose, it is considered to provide a chamfered portion, round chamfer, recessed chamfer or stepped recess. The chamfered portion is preferable in consideration of esthetical quality, material cost and the like. It is also sufficient to provide a rounded chamfer formed when the housing is molded in a die.

With regard to the conducting the connecting object into the fitting opening 30, employing the methods described above or below, it is possible to conduct it sufficiently without chamfering the ceiling portion 20 of the fitting opening 30.

Figure 7A:
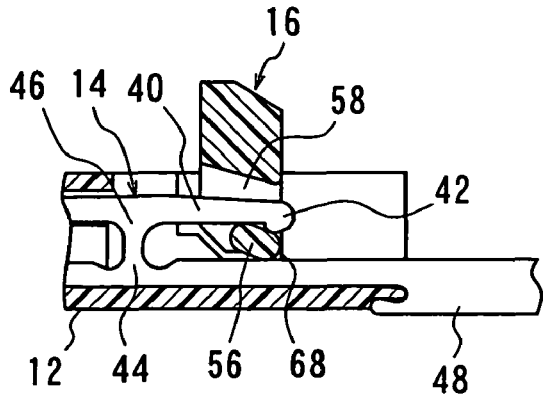
FIGS. 7A to 7E are explanatory views for explaining movements of the urging portions and their center of rotation with the pivotal movement of the pivoting member.
Figure 7B:
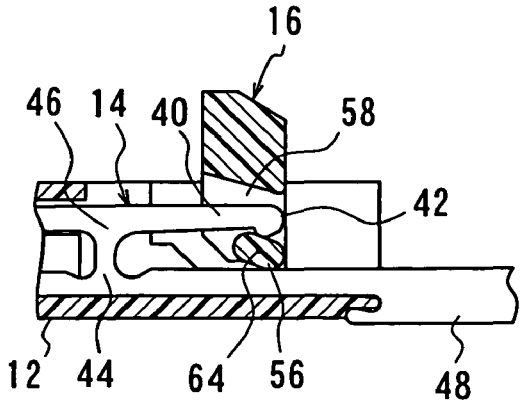
Figure 7C:
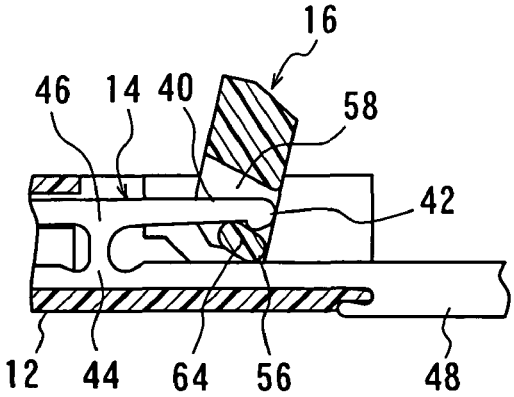
Figure 7D:
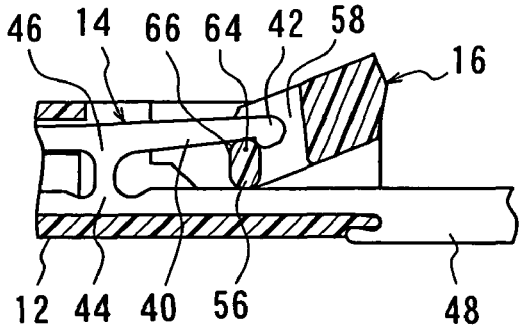
Figure 7E:
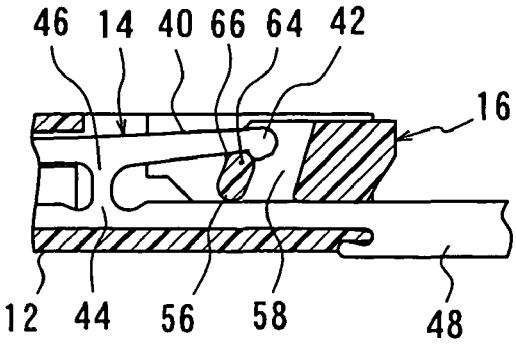
Figure 8:
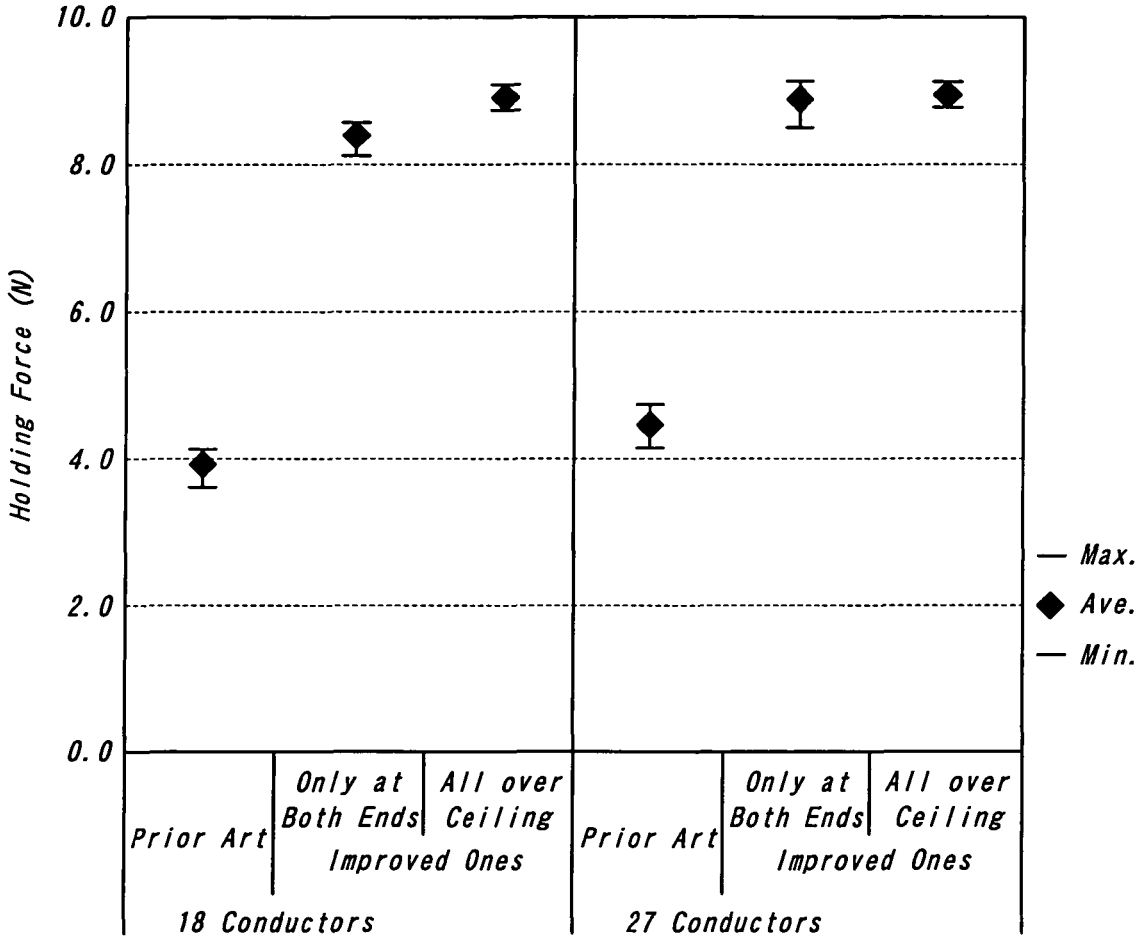
FIG. 8 is a graph illustrating how the holding force is increased by providing the protection wall according to the invention.

The movement and pivotal movement of the urging portions 56 of the pivoting member 16 will then be explained by referring to FIG. 7A to 7E. FIG. 7A illustrates the state that the connecting object is not inserted into the connector 10. The lower end 68 (the right end viewed in the drawing) of the urging portion 56 is positioned between the projection 42 of the pressure receiving portion 40 and the connection portion 48. As shown in FIG. 7B, when the actuating portion 60 of the pivoting member is pivotally moved (in the clockwise direction as viewed in the drawing), the urging portion 56 is moved in a direction opposite to the fitting opening 30 of the connector, and the lower end 68 of the urging portion 56 is embraced between the projection 42 of the pressure receiving portion 40 and the connection portion 48. As shown in FIG. 7C, when the actuating portion 60 is further pivotally moved, the urging portion 56 at its position in FIG. 7B is pivotally moved about the center of the urging portion 56 as the rotation axis 64. As shown in FIG. 7D, when the actuating portion 60 is further pivotally moved, the urging portion 56 at its position in FIG. 7C is pivotally moved about the center of the urging portion 56 as the rotation axis 64 so that the urging portion 56 stands substantially upright between the pressure receiving portion 40 and the connection portion 48, and the rotation axis 64 is moved toward the upper end 66 in contact with the projection 42. As shown in FIG. 7E, when the actuating portion 60 is further pivotally moved, the urging portion 56 at its position in FIG. 7D is pivotally moved about a center in the proximity of the upper end 66 in contact with the projection 42 so that the urging portion 56 engages the projection 42 in a manner the urging portion 56 catches the projection 42.

In other words, the urging portion 56 is initially moved and then pivotally moved, and when the urging portion 56 is further pivotally moved, the rotation axis 64 progressively changes so that the urging portion 56 performs the compact and space-saving pivotal movement (rotation).

In the connector 10 according to the invention, namely, first, when a connecting object such as the flexible printed circuit board 70 is inserted into the fitting opening 30 of the connector, a large force is not required because of the so-called "zero-insertion force" type. Then, the urging portion 56 of the pivoting member 16 is pivotally moved at a location on the side of the projection 42 of the contact 14 (to urge the pressure receiving portion 40 of the contact 14 upwardly at a location closer to the projection 42) so that the pivoting member can be locked with a small force. Moreover, the pressure receiving portion 40 of the contact 14 is urged upwardly on the side of the projection 42 by the urging portion 56 of the pivoting member 16 so that higher contact force can be obtained between the contact and the connecting object.

The fixtures 18 will then be explained. The fixtures 18 are made of a metal and formed by means of the press-working of the known technique. Preferred metals from which to form the fixtures 18 include brass, beryllium copper, phosphor bronze and the like which comply with the requirements such as springiness, electric conductivity and the like.

The fixture 18 is substantially a plate-shaped piece which is fixed to the extension wall 24 of the housing 12 by press-fitting, integral molding, welding, or the like. The positions of the fixtures 18 are designed in consideration of a customer's specification, the location on a substrate 80 at which the connector is mounted and the like. In the illustrated embodiment, the substrate 80 is formed with a notch 82, and the connector 10 is mounted on the substrate so that the substrate is positioned substantially at the middle of the thickness of the housing 12 and the pivoting member 16 can be operated on the opposite side of the other parts on the connector with respect to the substrate. The size of the fixtures 18 may be designed in consideration of their holding force, an area occupied by the substrate and the like.

Finally, mounting of the connector 10 onto the substrate 80 will be explained. In order to comply with the requirement for reduced overall height of connector in recent years, the substrate 80 is formed with the notch 82, and the connector 10 is mounted onto the substrate 80 in a manner to accommodate the connector in the notch 82 as shown in FIGS. 3A and 3B. In this manner, the total height including the substrate 80 and the connector 10 can be reduced. In other words, the total height of the connector can be reduced by the thickness of the substrate 80. If the thickness of a substrate is 0.4 mm, the total height of 1.0 mm of a connector until now can be reduced to approximately 0.6 mm. The size of the notch 82 of the substrate may be suitably designed in consideration of the size of the connector 10, the strength of the substrate 80, the position of mounting and the like.

The invention is applicable to connectors for use in electric and electronic appliances such as mobile appliances and the like, and more particularly to connectors superior in stable electrical connection with a connecting object such as a flexible printed circuit board or flexible flat cable and capable of being mounted on a side surface of a substrate.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector to be mounted to a side surface of a substrate, including a plurality of contacts each having at least one contact portion adapted to contact a connecting object, a housing for arranging and holding said contacts and having a fitting opening into which said connecting object is inserted, and a pivoting member causing said contacts to be elastically deformed and pressed against said connecting object, wherein said connector comprises:

said contacts each including a first piece having the contact portion at one end adapted to contact said connecting object, a pressure receiving portion at another end adapted to be pressed by said pivoting member, and a projection inwardly extending from the tip of said pressure receiving portion; a second piece having a further contact portion at one end, a connection portion at another end to be connected to the substrate, and a fulcrum portion between said further contact portion and said connection portion; and an elastic portion for connecting said first piece and said fulcrum portion, said contact portion, said elastic portion, said fulcrum portion and said connection portion being arranged in a form of a crank, said housing being provided at both longitudinal ends with extension walls for holding fixtures for fixing said housing of said connector against said substrate so as to reduce overall height, and said housing being formed with slits corresponding to anchoring portions of said housing and located between each said extension wall and a bearing for said pivoting member, said slits extending parallel to said contacts in a lengthwise direction and extending a depth of the entire housing, and said slits providing elasticity for facilitating engagement of locking portions of said pivoting member with said anchoring portions of said housing, and said housing including a ceiling portion for covering said contact portions of said contacts, said ceiling portion being provided with protection wall ends at said fitting opening for preventing said ceiling portion from being deformed and said contacts from being disconnected from a connecting object when said connecting object is subjected to an upward force, and said pivoting member including an actuating portion for pivotally moving said pivoting member, urging portions continuously arranged in a longitudinal direction of said pivoting member, and anchoring holes independent from one another for receiving therein said pressure receiving portions and adapted to engage said projections, respectively, said pivoting member being mounted on said housing so that said urging portions are pivotally moved between said connection portions and said pressure receiving portions of said contacts, and a rotation axis of said urging portions is moved with a pivotal movement to achieve a compact rotation, and wherein said substrate is provided with a notch at said side surface, and said connector is connected onto said substrate in a manner that said connector is accommodated in said notch of said substrate so as to reduce a combined height of said connector and said substrate.

2. The connector as set forth in claim 1, wherein said connector is connected onto the substrate such that said substrate is positioned on an upper surface of the connection portions of said contacts, and said pivoting member is operated on an opposite side of the connection portions of said contacts with respect to said substrate.

3. The connector as set forth in claim 1, wherein when the connecting object is connected to the connector, the urging portions of said pivoting member are positioned such that before connecting said connecting object to said connector, the lower ends of said urging portions are positioned between the projections of said pressure receiving portions and said connection portions of said contacts, that second on pivotally moving said actuating portion of the pivoting member, said urging portions are moved in a direction opposite to said fitting opening so that the lower ends of said urging portions are embraced between the projections of said pressure receiving portions and said connection portions of said contacts, that third on further pivotally moving said actuating portion of the pivoting member, said urging portions at their second position are pivotally moved about a center of said urging portions as their rotation axis, that fourth on further pivotally moving said actuating portion of the pivoting member, said urging portions at their third position are pivotally moved about the center of said urging portions as their rotation axis so that said urging portions stand substantially upright between said pressure receiving portions and said connection portions, and the rotation axis is moved toward the upper ends of said urging portions in contact with said projections, and that finally on further pivotally moving said actuating portion of the pivoting member, said urging portions at their fourth position are pivotally moved about a center in the proximity of the upper ends of said urging portions in contact with said projections to cause said urging portions to engage said projections.

4. A connector to be mounted to a side surface of a substrate, including a plurality of contacts each having at least one contact portion adapted to contact a connecting object, a housing for arranging and holding said contacts and having a fitting opening into which said connecting object is inserted, and a pivoting member causing said contacts to be elastically deformed and pressed against said connecting object, wherein said connector comprises:

said contacts each including a first piece having the contact portion at one end adapted to contact said connecting object, a pressure receiving portion at another end adapted to be pressed by said pivoting member, and a projection inwardly extending from the tip of said pressure receiving portion; a second piece having a further contact portion at one end, a connection portion at another end to be connected to the substrate, and a fulcrum portion between said further contact portion and said connection portion; and an elastic portion for connecting said first piece and said fulcrum portion, said contact portion, said elastic portion, said fulcrum portion and said connection portion being arranged in a form of a crank, said housing being provided at both longitudinal ends with extension walls for holding fixtures for fixing said housing of said connector against said substrate so as to reduce overall height, and said housing being formed with slits corresponding to anchoring portions of said housing and located between each said extension wall and a bearing for said pivoting member, said slits extending parallel to said contacts in a lengthwise direction and extending the a depth of the entire housing, and said slits providing elasticity for facilitating engagement of locking portions of said pivoting member with said anchoring portions of said housing, and said housing including a ceiling portion for covering said contact portions of said contacts, said ceiling portion being provided with protection wall ends at said fitting opening for preventing said ceiling portion from being deformed and said contacts from being disconnected from a connecting object when said connecting object is subjected to an upward force, said protection wall ends not being chamfered or inclined, and said pivoting member including an actuating portion for pivotally moving said pivoting member, urging portions continuously arranged in a longitudinal direction of said pivoting member, and anchoring holes independent from one another for receiving therein said pressure receiving portions and adapted to engage said projections, respectively, said pivoting member being mounted on said housing so that said urging portions are pivotally moved between said connection portions and said pressure receiving portions of said contacts, and a rotation axis of said urging portions is moved with a pivotal movement to achieve a compact rotation, and wherein said substrate is provided with a notch at said side surface, and said connector is connected onto said substrate in a manner that said connector is accommodated in said notch of said substrate so as to reduce a combined height of said connector and said substrate.

5. The connector as set forth in claim 4, wherein said connector is connected onto the substrate such that said substrate is positioned on an upper surface of the connection portions of said contacts, and said pivoting member is operated on an opposite side of the connection portions of said contacts with respect to said substrate.

6. The connector as set forth in claim 4, wherein when the connecting object is connected to the connector, the urging portions of said pivoting member are positioned such that before connecting said connecting object to said connector, the lower ends of said urging portions are positioned between the projections of said pressure receiving portions and said connection portions of said contacts, that second on pivotally moving said actuating portion of the pivoting member, said urging portions are moved in a direction opposite to said fitting opening so that the lower ends of said urging portions are embraced between the projections of said pressure receiving portions and said connection portions of said contacts, that third on further pivotally moving said actuating portion of the pivoting member, said urging portions at their second position are pivotally moved about a center of said urging portions as their rotation axis, that fourth on further pivotally moving said actuating portion of the pivoting member, said urging portions at their third position are pivotally moved about the center of said urging portions as their rotation axis so that said urging portions stand substantially upright between said pressure receiving portions and said connection portions, and the rotation axis is moved toward the upper ends of said urging portions in contact with said projections, and that finally on further pivotally moving said actuating portion of the pivoting member, said urging portions at their fourth position are pivotally moved about a center in the proximity of the upper ends of said urging portions in contact with said projections to cause said urging portions to engage said projections.

* * * * *